United States Patent [19]

Nozaki

[11] Patent Number: 4,494,918

[45] Date of Patent: Jan. 22, 1985

[54] AUXILIARY RADIALLY SHIFTING MECHANISM FOR VANES IN A PUMP OF THE VANE TYPE

[75] Inventor: Tadashi Nozaki, Hyogo, Japan

[73] Assignee: Mitsubishi Denki Kabushiki Kaisha, Tokyo, Japan

[21] Appl. No.: 400,716

[22] Filed: Jul. 22, 1982

[51] Int. Cl.[3] ..... F04C 2/00
[52] U.S. Cl. ..... 418/260
[58] Field of Search ..... 418/260–265

[56] References Cited

U.S. PATENT DOCUMENTS 643,432 2/1900 Washington ..... 418/260
1,395,916 11/1921 Hayes ..... 418/259

FOREIGN PATENT DOCUMENTS 51-9705 3/1976 Japan .
52-24806 6/1977 Japan .
53-114509 10/1978 Japan .
54-164906 11/1979 Japan .

*Primary Examiner*—John J. Vrablik
*Assistant Examiner*—Jane E. Obee
*Attorney, Agent, or Firm*—Wenderoth, Lind & Ponack

[57] ABSTRACT

An auxiliary radially shifting mechanism for vanes in a pump of the vane type having a cup-shaped cylinder, a rotor eccentrically and rotatably received within the cylinder, a number of vanes radially shiftably disposed within the rotor, and a bracket closing the cylinder at its open end, is provided in the form of a ring-shaped element formed on the bracket so as to protrude therefrom towards the side of the vanes in such a manner that it is disposed asymmetrically but only partially around the center of the rotor.

3 Claims, 5 Drawing Figures

AUXILIARY RADIALLY SHIFTING MECHANISM FOR VANES IN A PUMP OF THE VANE TYPE

BACKGROUND OF THE INVENTION

1. Field of the Invention

The present invention relates to a pump and more particularly to an improvement in an auxiliary radially shifting mechanism for vanes in a pump of the vane type.

2. Description of the Prior Art

Hitherto, the pumps of this type have generally had a constitution such as that illustrated in FIGS. 1, 2, and 3 of the attached drawings in which a rotor 5, fixedly secured to a driving shaft 1, is rotatably received within a cup-shaped cylinder 2, said rotor 5 being eccentric to the center of the cylinder. A number of vanes 7 is disposed within slots 5*a* formed in rotor 5 so as to be radially shiftable, and these vanes 7 are adapted to have their radial outer ends abut against the inner periphery of cylinder 2 so that fluid is sucked through a suction port 8 provided in cylinder 2 to be discharged throgh a discharge port 9 also provided in cylinder 2. In the drawings, the reference numeral 3 is a bracket secured to cylinder 2 to sealingly close cylinder 2; 4 is a bearing to rotatably support driving shaft 1 in bracket 3; 6 is a fluid seal to prevent the fluid within cylinder 2 from leaking; and 3*a* is a ring-shaped projection provided on bracket 3 so as to be concentric with cylinder 2.

The operation of the pump described above is as follows.

As rotor 5 is rotated by means of driving shaft 1 by a prime mover (not shown), centrifugal force is applied to vanes 7 radially shiftably disposed within slots 5*a* formed in rotor 5 so that they are urged radially outwards in slots 5*a*, vanes 7 revolving relative to cylinder 2 with their radially outward end portions abutting against the inner periphery of cylinder 2. Due to the constitution as above described, as vanes 7 revolve, the fluid enclosed within fluid delivery chambers 2*a* and 2*b* each defined by the inner periphery of cylinder 2, rotor 5 and neighboring vanes 7 is discharged through discharge port 9, new fluid being again sucked through suction port 8, and thus the pump functions as a fluid pump to deliver the fluid under pressure. In this conventional pump, ring-shaped projection 3*a* provided on bracket 3 and being concentric with cylinder 2 acts such that, when the centrifugal force applied to vanes 7 is low as a result of a low rotary speed of rotor 5, it forcefully thrusts vanes 7 radially outwards with respect to rotor 5 so as to cause the radially outward ends of vanes 7 to abut against the inner periphery of cylinder 2 so as to form fluid delivery chambers 2*a* and 2*b*.

From the foregoing it will be appreciated that the conventional pump of the vane type having the constitution and the operation as above described exhibits such defects that, at the time of a low rotational speed of rotor 5, since the centrifugal force to be applied to vanes 7 is low, when the fluid pressure at the side of suction port 8 varies, the varied fluid pressure acts as a force to urge vanes 7 downwards, causing vane 7 to exhibit a hunting phenomenon i.e. oscillating up and down in an effort to find an equilibrium position, thus causing incomplete closure of fluid delivery chambers between the inner periphery of cylinder 2 and the outer periphery of ring-shaped projection 3*a*, as the result of which vanes 7 impinging upon the outer periphery of ring-shaped projection 3*a* are partially subjected to abnormal wear. Incidentally this hunting phenomenon or oscillation is remarkably experienced in the range over 180° after completion of the raising of the vanes 7.

SUMMARY OF THE INVENTION

It is an object of the present invention to provide an improved auxiliary radially shifting mechanism for vanes in a pump of the vane type which can avoid the defects in the conventional mechanism as described above.

It is another object of the present invention to provide an auxiliary radially shifting mechanism for vanes in a pump of the vane type which can prevent the vanes from being abnormally worn owing to the occurrence of a hunting phenomenon or oscillation between the inner periphery of the cylinder of the pump and the auxiliary shifting mechanism even if the rotational speed of the rotor of the pump is low.

In accordance with the present invention, an auxiliary radially shifting mechanism for vanes in a pump of the vane type is provided, wherein the ring-shaped projection, provided on the bracket of the cylinder of the pump as the auxiliary radially shifting mechanism, is so shaped that it is not symmetric with respect to and only partially surrounding the center of the rotor.

BRIEF DESCRIPTION OF THE DRAWINGS

Other objects and advantages of the present invention will become apparent from the following description considered in conjunction with the accompanying drawings wherein there are set forth by way of illustration and example certain embodiments of the present invention, in which.

In the drawings similar or corresponding elements bear identical reference numerals throughout.

DESCRIPTION OF THE PREFERRED EMBODIMENTS

Figure 1:
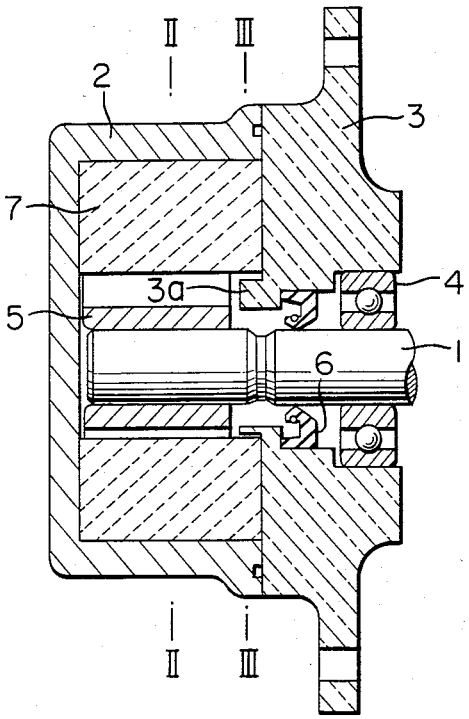
FIG. 1 PRIOR ART
FIG. 1 is a longitudinal sectional view of a conventional pump of the vane type.
Figure 2:
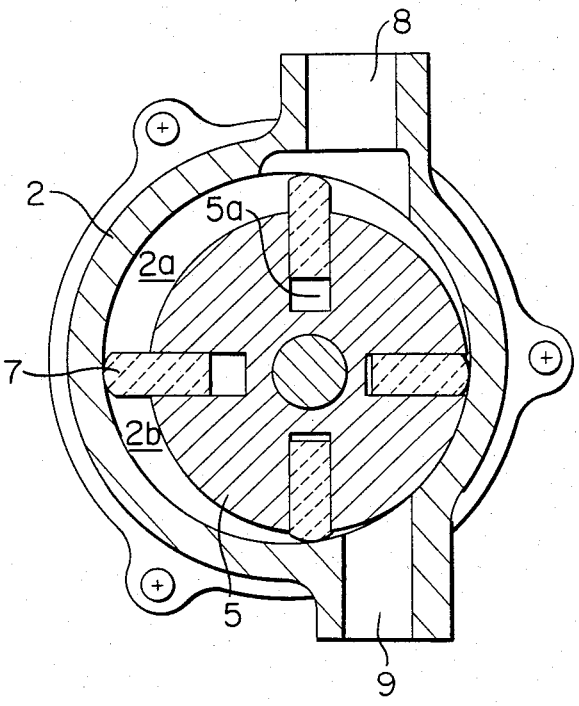
FIG. 2 PRIOR ART
FIG. 2 is a cross-sectional view of the pump shown in FIG. 1 taken along the line II—II of FIG. 1.
Figure 3:
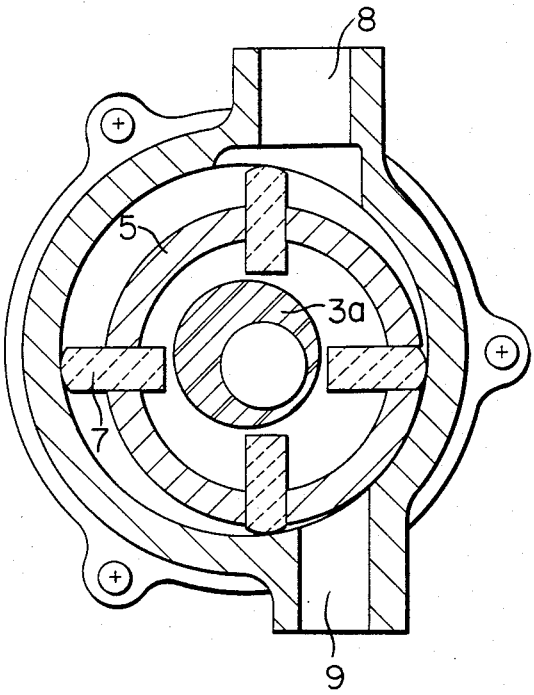
FIG. 3 PRIOR ART
FIG. 3 is a cross-sectional view of the pump shown in FIG. 1 taken along the line III—III of FIG. 1.
Figure 4:
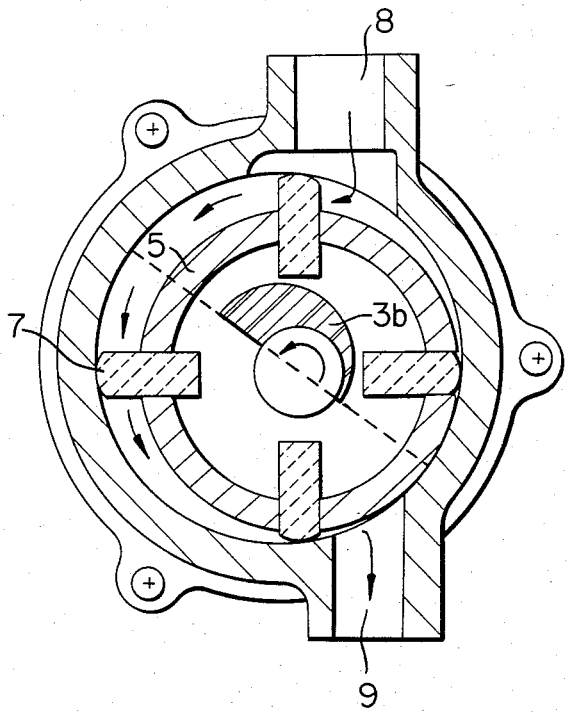
FIG. 4 is a cross-sectional view similar to FIG. 3, but showing one embodiment of the present invention.

Referring now to FIG. 4 of the attached drawings, an embodiment of the present invention is shown wherein the reference numeral 3*b* is an auxiliary radially shifting mechanism for vanes in accordance with the present invention. At this point it should be noted that it is assumed that in the pump shown in FIG. 4 the other elements other than auxiliary radially shifting mechanism 3*b* have the same constitutions as those shown in FIGS. 1 to 3. Thus, auxiliary radially shifting mechanism 3*b* is so shaped that it is provided on bracket 3 as shown in FIG. 1 so as to protrude therefrom towards the side of cylinder 2 concentric therewith, but as shown in FIG. 4 it surrounds driving shaft 1 only partially, e.g. around about 180° thereof.

As will be apparent from the comparison of FIG. 4 with FIG. 3, since in the present invention auxiliary radially shifting mechanism 3*b* has a semicircular shape nonsymmetric but only partially encircling about the center of driving shaft 1 rather than being completely encircling as in the conventional mechanism such as that shown in FIG. 3 at projection 3*a*. Even if vanes 7 behave in an unstable manner, such as hunting or oscillating due to insufficient centrifugal force applied to vanes 7 at a time of low rotational speed of driving shaft 1, vanes 7 do not impinge upon auxiliary radially shifting mechanism 3*b* after vanes 7 have been once forced radially outwards at the time of their passing through the vicinity of suction port 8 of cylinder 2, because there is no auxiliary radially shifting mechanism 3*b* after passing through the vicinity of suction port 8 and thus the undesirable wear of vanes 7 is prevented.

Figure 5:
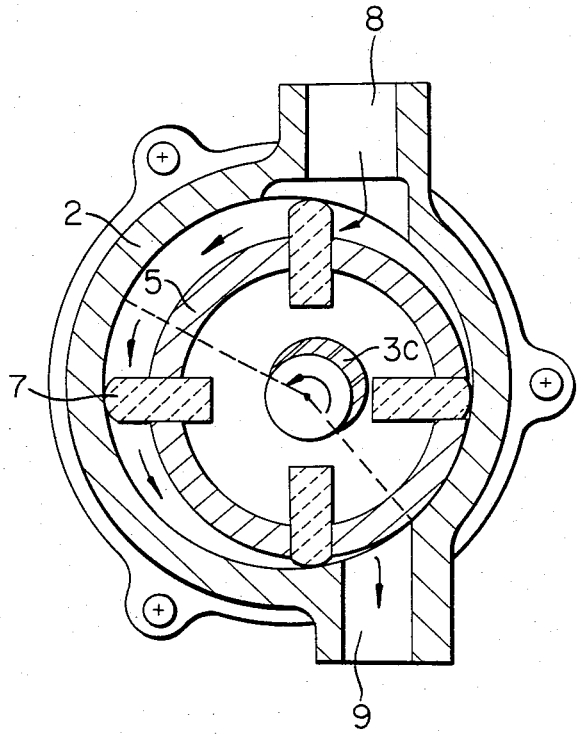
FIG. 5 is a view similar to FIG. 4 showing another embodiment of the present invention.

FIG. 5 shows a modified embodiment of the present invention in which an auxiliary radially shifting mechanism 3*c* has a configuration nonsymmetric about the center of cylinder 2, as does auxiliary shifting mechanism 3*b* shown in FIG. 4, but the shape substantially differs from the latter, i.e. auxiliary shifting mechanism 3*c* is of substantially a crescent shape. However, it will be apparent that auxiliary radially shifting mechanism 3*c* operates in a manner wholly similar to that of auxiliary radially shifting mechanism 3*b* shown in FIG. 4.

It is to be understood that although only certain forms of the present invention have been illustrated and described, it is not to be limited thereto except insofar as such limitations are included in the following claims.

What is claimed is:

1. In a pump of the vane type having a cup-shaped cylinder with a suction port and a discharge port, each port having a mouth with upstream and downstream sides, A rotor eccentrically and rotatably received within said cylinder, a number of vanes radially shiftably disposed within said rotor and adapted to be rotated relative to said cylinder as said rotor rotates so as to have their radially outward ends abut against the inner periphery of said cylinder in order to form fluid delivery chambers, whereby fluid is sucked through said suction port and discharged through said discharge port under pressure, and a bracket to close said cylinder at its open end, wherein the improvement comprises:

an auxiliary radially shifting means for eliminating a hunting phenomenon of said vanes, said means being disposed on said bracket in a vicinity extending in the direction of rotation only from a point near the downstream side of the mouth of said discharge port to a point just beyond the downstream side of the mouth of said suction port of said cylinder, so that abnormal wear of the vanes is prevented in a vicinity extending in a direction of rotation from a point just beyond the downstream side of the mouth of the suction port of said cylinder to a point near the downstream side of the mouth of the discharge port of said cylinder.

2. The auxiliary radially shifting means for vanes in the pump of the vane type as claimed in claim 1 wherein said means has a shape substantially of a crescent form.

3. The auxiliary radially shifting means for vanes in the pump of the vane type as claimed in claim 1 wherein said means has a shape substantially of a semi-circular form.

* * * * *